US007201683B2

(12) United States Patent
Estape et al.

(10) Patent No.: US 7,201,683 B2
(45) Date of Patent: Apr. 10, 2007

(54) ELASTIC GRIP HANDLE FOR A BASEBALL/SOFTBALL BAT

(76) Inventors: Roberto Estape, 2649 NE. 37th Dr., Ft. Lauderdale, FL (US) 33308; Frank Acosta, 5200 Blue Lagoon Dr., Suite 750, Miami, FL (US) 33126

( * ) Notice: Subject to any disclaimer, the term of this patent is extended or adjusted under 35 U.S.C. 154(b) by 0 days.

(21) Appl. No.: 10/429,807

(22) Filed: May 5, 2003

(65) Prior Publication Data

US 2004/0224804 A1 Nov. 11, 2004

(51) Int. Cl.
*A63B 59/06* (2006.01)

(52) U.S. Cl. ..... 473/568

(58) Field of Classification Search ..... 473/519, 473/520, 564–568, 457
See application file for complete search history.

(56) References Cited

U.S. PATENT DOCUMENTS

| | | | | | |
|---|---|---|---|---|---|
| 1,165,484 | A | * | 12/1915 | Zimmerman | 473/568 |
| 2,091,458 | A | * | 8/1937 | Sleight | 16/421 |
| 2,101,714 | A | * | 12/1937 | Keeney | 473/341 |
| 3,433,481 | A | * | 3/1969 | Tanguay | 473/568 |
| 3,469,839 | A | | 9/1969 | Pietronuto et al. | |
| 3,779,551 | A | * | 12/1973 | Wilson | 473/568 |
| 3,927,466 | A | | 12/1975 | Rosalsky | |
| 4,248,425 | A | | 2/1981 | Easton et al. | |
| 4,653,754 | A | * | 3/1987 | Cross | 473/568 |
| 5,342,046 | A | | 8/1994 | Erb | |
| 5,482,270 | A | | 1/1996 | Smith | |
| 5,577,722 | A | | 11/1996 | Glassberg | |
| 5,624,114 | A | | 4/1997 | Kelsey | |
| 5,839,983 | A | | 11/1998 | Kramer | |
| 5,867,868 | A | | 2/1999 | Ward | |
| 6,234,924 | B1 | | 5/2001 | Washburn, Jr. | |
| D444,193 | S | | 6/2001 | Dodson | |
| 6,277,040 | B1 | * | 8/2001 | Randolph | 473/568 |
| 6,372,323 | B1 | * | 4/2002 | Kobe et al. | 428/119 |
| 6,406,387 | B1 | | 6/2002 | Ryan | |
| 6,652,398 | B2 | * | 11/2003 | Falone et al. | 473/568 |

* cited by examiner

*Primary Examiner*—Mark S. Graham
(74) *Attorney, Agent, or Firm*—John C. Smith

(57) ABSTRACT

A resilient elastic bat grip for baseball and softball bats that covers the knob on the bat handle. The grip has a bulbous shape which is wider then the knob of the baseball bat, and fits snugly in the batter's palm such that the bat is controlled by one or more fingers and swung with the batter's wrist below the end of the bat. The grip does not require all five fingers to hold the bat, and as a result, increases the maneuverability of the wrist which allows greater bat speed and whipping motion. A rounded base enables a single, double or triple finger drop for more bat speed and less wrist rigidity. This also allows added finger support for better control of the head of the bat during the swing as it passes through the power zone.

20 Claims, 8 Drawing Sheets

ELASTIC GRIP HANDLE FOR A BASEBALL/SOFTBALL BAT

CROSS-REFERENCE TO RELATED APPLICATIONS

This application is related to, and claims the benefit of, the provisional patent application entitled "Elastic Grip Handle for a Baseball/Softball Bat", filed Jan. 14, 2003, bearing U.S. Ser. No. 60/439,906 and naming Roberto Estape and Frank Acosta, the named inventors herein, as sole and joint inventors, the contents of which is specifically incorporated by reference herein in its entirety.

BACKGROUND OF THE INVENTION

1. Technical Field

The present invention relates to baseball/softball equipment. In particular, it relates to an elastomeric grip/handle which attaches to the knob of a baseball/softball bat and allows the batter to swing the bat while holding the bat knob without interference with the batter's wrist motion, which results in reduced likelihood of injuries to the batter, which results in improved comfort for the batter while manipulating the bat, and which results in higher bat velocity and increased ball flight distance when the ball is struck by the bat.

2. Background

The games of baseball and softball have been played for many years. Originally, baseball was played with a simple stick and a ball having a relatively simple construction. Over time, numerous improvements were made to both the bat and the ball. Usually, these improvements were made to increase in ball flight distance and to increase the usability of the bat.

For ease of discussion, the terms "baseball bat," "softball bat," and "bat" may be used interchangeably herein to describe both baseball bats (e.g., which uses a smaller hard ball) and softball bats (e.g., which uses a larger ball). An early problem which became apparent in regard to the use of baseball/softball bats, was a loss of control of the bat which occasionally slipped out of the batter's hand while swinging and created a potential risk of injury to other players. To avoid this safety hazard, the proximal end of the bat, adjacent to the batter's hands, were equipped with a knob whose function was to prevent the bat from slipping from batter's hands when swinging. This simple use of a knob on the proximal end of the bat substantially reduced the number of times a batter lost control of a bat and flung it while swinging the bat. While addressing the loss of control problem, the knob on the proximal end of the bat created several new problems.

For example, many individuals who play baseball or softball do not own their own bats. Quite often, a team will own several bats which are shared by the players. One problem created by this situation is that each player is different in terms of physical size, strength, arm length, finger length, etc. Since multiple batters may share the same bat, the bat which is the perfect size for one batter may have a bat knob or shaft that is too thick or too small for another batter. In the case where a batter is using the bat which is too long, a variety of devices have been developed to help the batter to "shorten up" a bat. The term shorten up refers to gripping the bat on its handle away from its proximal end.

A number of devices have been developed to assist the batter in shortening up the batter's grip. Typically, they involve the use of flexible pads which are installed onto a baseball/softball bat adjacent to the knob. When a batter grasps the bat, the batter's hand rests against the flexible pads rather than the knob of the baseball/softball bat. By varying the number of pads, the batter can adjust where on the bat handle the bat is to be gripped. These types of spacing devices actually reduce the speed at which the bat strikes a baseball because the effective length of the bat is shortened and leverage is reduced. As a result, a batter using this type of device will experience reduced distance and power when a baseball or softball is struck.

Another approach to this problem has been the development of specialized gripping surfaces which are attached to the narrow end of the bat above its proximal end where the knob is located. They are not designed to allow a batter to hold the bat by the knob. It would be desirable to have the ability to grasp the bat by the knob, thereby improving freedom of movement while at the same time improving leverage when swinging a conventional bat.

Another issue related to prior art bats is the potential injury to a batter's hand from repetitious swinging of a baseball/softball bat. The prior art has also attempted to address this issue by providing pads which fit on the knob of a baseball/softball bat. These knobs intervene between the batter's hand and the knob of the baseball/softball bat to reduce impact and friction injuries to the batter's hand. These devices also have the adverse effect of reducing leverage because the hand is moved away from the proximal end of the bat.

While the prior art has provided several devices designed to provide a more secure grip on the baseball/softball bat and to reduce potential injury to the hand of the batter caused by repetitive swinging, the prior art has not provided a method of improving the freedom of motion of the batter's wrist. In addition, the prior art has not provided a method of allowing a batter to take advantage of the entire length of the bat by allowing the batter to grasp the knob of the baseball/softball bat with only a few fingers secured the bat knob in the palm of the batter's hand. Of course, the prior art has failed to provide a device which simultaneously achieves all of these goals.

SUMMARY OF THE INVENTION

The present invention provides a resilient elastic baseball/softball bat grip or knob cover which allows the batter to make use of the entire length of the baseball/softball bat, which increases the batter's leverage, which increases the speed at which a bat can be swung, and which reduces the potential for injury to a batter's hand, fingers, and/or wrist. The elastic grip is stretched over the knob at the end of the bat handle. It can be temporarily attached to the end of the baseball/softball bat and either secured by elastic pressure, or permanently attached to the bat by adhesives, tape, or any other suitable securing means. An upper ridge is provided which increases safety by increasing finger hold on the bat. The increased finger hold reduces the chance that the batter will lose control of the bat. Below the ridge, the side of the elastic grip forms a rounded, curved, or oblong outer surface which is designed to ergonomically fit into the wedge of the thumb and the crease of the palm, thereby increasing the surface area of contact with the batter's hand and increasing bat control. The increased surface area, the upper ridge and a rough textured coating provide greater friction and surface tension throughout the swing thereby increasing safety and control of the bat.

The rough textured surface also allows the batter to safely secure the bat with less hand pressure. As a result, the batter's hand can be more relaxed. A rounded base allows for a single, double or triple finger drop which increases bat speed and reduces wrist rigidity. The reduced number of fingers grasping the elastic grip increases the maneuverability of the wrist therefore allowing greater bat speed and whipping motion, which in turn results in increased power and ball flight distance when the ball is hit. The dropped fingers also provide added support to the base of the bat for better control of the head of the bat during the swing as it passes through the power zone.

The grip not only enhances greater bat speed, distance and control for all ages, it also provides greater safety and prevents soft tissue injury during batting practice or continued use. The elastic grip provides extra gripping surface tension and pliability for greater gripping force with less hand and finger contraction while enhancing comfort and providing injury protection. In addition, the resilient elastic material from which the grip is made also provides reverberation dampening to further reduce the possibility of injury to the batter's hand or wrist.

The grip to be fabricated from a variety of resilient elastic materials. As used herein, the term "resilient elastic materials" includes any suitable material which can be used to fabricate the grip, including materials such as thermal plastic rubber, Kraton(tm), sanopreme, or any other thermal plastic or thermal set rubber, elastomer or any silicone based material or polyvinyl chloride material that attaches to baseball and softball bats of wood or metal to assist with grip, form, hand placement, safety, injury prevention, wrist mobility, control and bat speed.

In addition to the foregoing resilient elastic materials, it has been found that the addition of a filler to resilient elastic materials can further improve the batter's control of the bat by further reducing the chance of slippage when swinging. Those skilled in the art will recognize that the filler can be made from any number of materials which are mixed with the resilient elastic materials to provide a surface with greater friction. The only requirement is that the material used to create the filler must be suitable for combination with the particular resilient elastic materials used to fabricate the grip.

One such filler is fiberglass which has been found to be a suitable material that can be combined with the resilient elastic materials during the fabrication process to provide a grip that will provide an improved level of surface friction. Of course, as noted above, a variety of other materials can also be used as fillers, in addition to fiberglass, so long as they are compatible with the elastic materials and produce the desired increase in surface friction. The increased surface friction in turn improves the batter's control of the grip.

In the preferred embodiment, the filler is envisioned as a small amount of fiberglass, on the order of ten percent (10%), that is added to the resilient elastic materials. However, those skilled in the art will realize that the amount of fiberglass added to the resilient elastic materials is not critical and can vary. In fact, the amount of fiberglass that is used can be varied to increase or decrease the relative surface friction level of the grip. For example, an increase from ten percent to twenty or twenty-five percent in the total amount of fiberglass used would create an increase in the relative surface friction level of the grip. Likewise, a reduction to a reduced level of fiberglass, such as one percent, will result in a corresponding reduction in relative surface friction.

Another advantage of fillers is that in addition to increasing the batter's control of the bat, fillers may also increase the durability of the grip. The fiberglass filler discussed above is one such example of a filler that can increase the durability of a grip. Of course, the type of filler selected will vary in terms of its durability.

In addition to its use as a grip during an actual ball game, the grip can also be used as a training tool for proper hand placement, finger placement, and body mechanics. Likewise, it can be made of any color or design, i.e. silver, blue, team logos, etc. In fact, it can have substantial value as a method of displaying commercial logos or messages.

DESCRIPTION OF THE PREFERRED EMBODIMENT

Prior to a detailed discussion of the figures, a general overview of the system will be presented. The invention provides an elastic grip handle which attaches to the knob of a baseball/softball bat. The elastic grip handle is designed to be flexible enough to allow it to be stretched over the knob of a baseball/softball bat. The elastic grip handle further has an internal cavity shaped like the knob of the baseball/softball bat which, when the knob of the bat is inserted into the cavity, secures the elastic grip handle to the baseball/softball bat.

Elastic grip handle has a generally rounded shape which is sized to fit within the palm of a batter. The elastic grip handle also has a ridge at its distal end which provides a gripping surface for one or more of the batter's fingers. The gripping surface is intended to insure that the batter does not lose control of the bat. In addition, the rounded shape which fits within the batter's palm allows the batter to hold the bat with the batter's thumb and one or more fingers. The remaining fingers typically will rest the proximal end the elastic grip handle and provide further control when the batter is swinging the bat.

Because the elastic grip handle allows the batter to control the bat with two or more fingers, the bat can be held at its proximal end. By holding the bat at its end, the batter can take advantage of the entire length of the bat, which provides increased leverage that in turn results in increased bat speed and therefore power when the ball is hit. In addition, since the elastic grip handle allows the batter to hold the bat at a high location in the batter's hand, the knob of the bat does not interfere with movement of the batter's wrist. This provides unimpeded wrist movement. The improved freedom of motion of the batter's wrists results in higher velocity bat swings which in turn improves ball flight distance and batting power. An additional benefit associated with the improved freedom of wrist motion is an improvement in safety since potential injuries caused by knob/wrist/finger/hand contact are reduced.

Having discussed the features and advantages of the invention in general, we turn now to a more detailed discussion of the figures.

Figure 1:
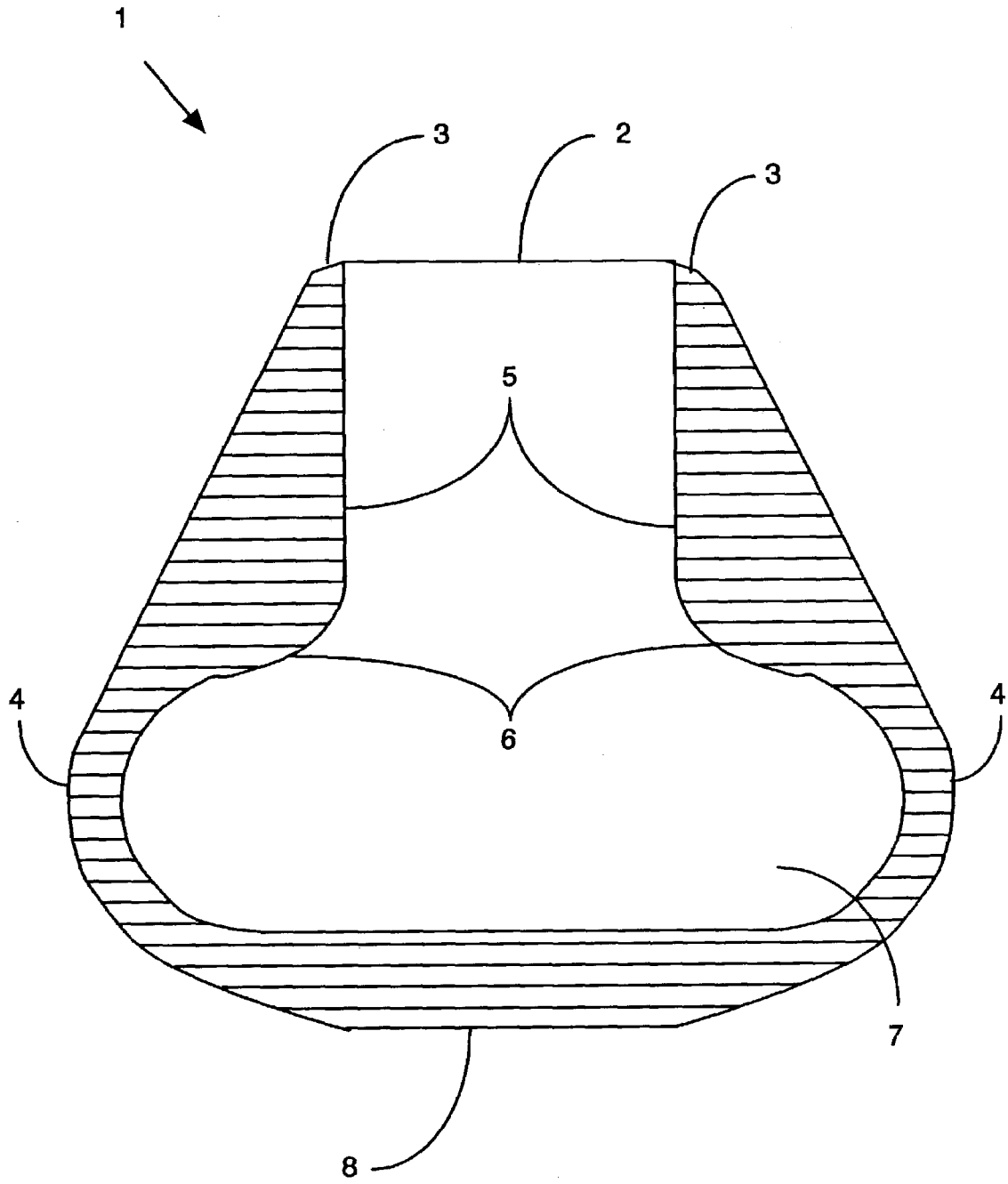
FIG. 1 is a side cutaway view of a preferred embodiment of the elastic grip handle.

FIG. 1 illustrates a cutaway side view of a preferred embodiment of the elastic grip handle 1. This embodiment illustrates a generally rounded external shape of the elastic grip handle 1. A handle aperture 2 provides access to a knob cavity 7 inside the elastic grip handle 1. The knob cavity 7 is sized to snugly fit the knob 10 of the baseball/softball bat 9 (shown in FIG. 2). When the bat 9 is inserted into the elastic grip 1, the protrusion 6 in knob cavity 7 will rest against the upper surface of the knob 10 (shown in FIG. 2) of the bat and secure the knob in place. Internal walls 5 in the elastic grip handle 1 define a channel which accepts the handle of bat 1 above the knob 10. The channel is also sized to snugly fit the bat handle.

Also shown in this figure is a ridge 3 which provides a gripping surface at the distal end of the elastic grip handle 1. When swinging the bat, the batter would typically have one finger resting on the ridge 3. This provides the batter with better control by preventing the bat from slipping from the batter's hand when swinging the bat 9. The rounded bulge 4 towards the proximal end of the elastic grip handle 1 is designed to fit in the crease between the batter's thumb and the palm of the batter's hand. This increased surface contact provides additional control over the handle by increasing the amount of surface in contact with the batter's hand when the bat 9 is swung. The proximal end 8 provides a surface where one or more fingers may rest when the bat 9 is swung. Placement of the figures in this location also helps to control the bat's motion and stability.

Those skilled in the art will recognize that different types of bats 9 (e.g., wood, metal, as well as baseball bats, softball bats, etc.) may vary in shape and size. As a result, the dimensions of the elastic grip handle 1 may also vary to suit to a particular type of bat 9.

The elastic grip handle 1 can be fabricated from any suitable material. The requirements for the material used to fabricate the elastic grip handle 1 are that it be elastic enough so that it can be stretched to insert the knob 10 of a bat 9. A number of commercially available materials are suitable for fabrication of the elastic grip handle 1. For example, a thermal plastic rubber such as Kraton(™), or sanopreme, or any other thermal plastic or thermal set rubber, elastomer or any silicone based material or polyvinyl chloride material can be used.

In addition to the wide range of materials used to fabricate the elastic grip handle 1, numerous decorative features such as colors, team logos, etc. can also be incorporated into the elastic grip handle 1 for a wide variety of aesthetic and/or commercial purposes.

Figure 2:
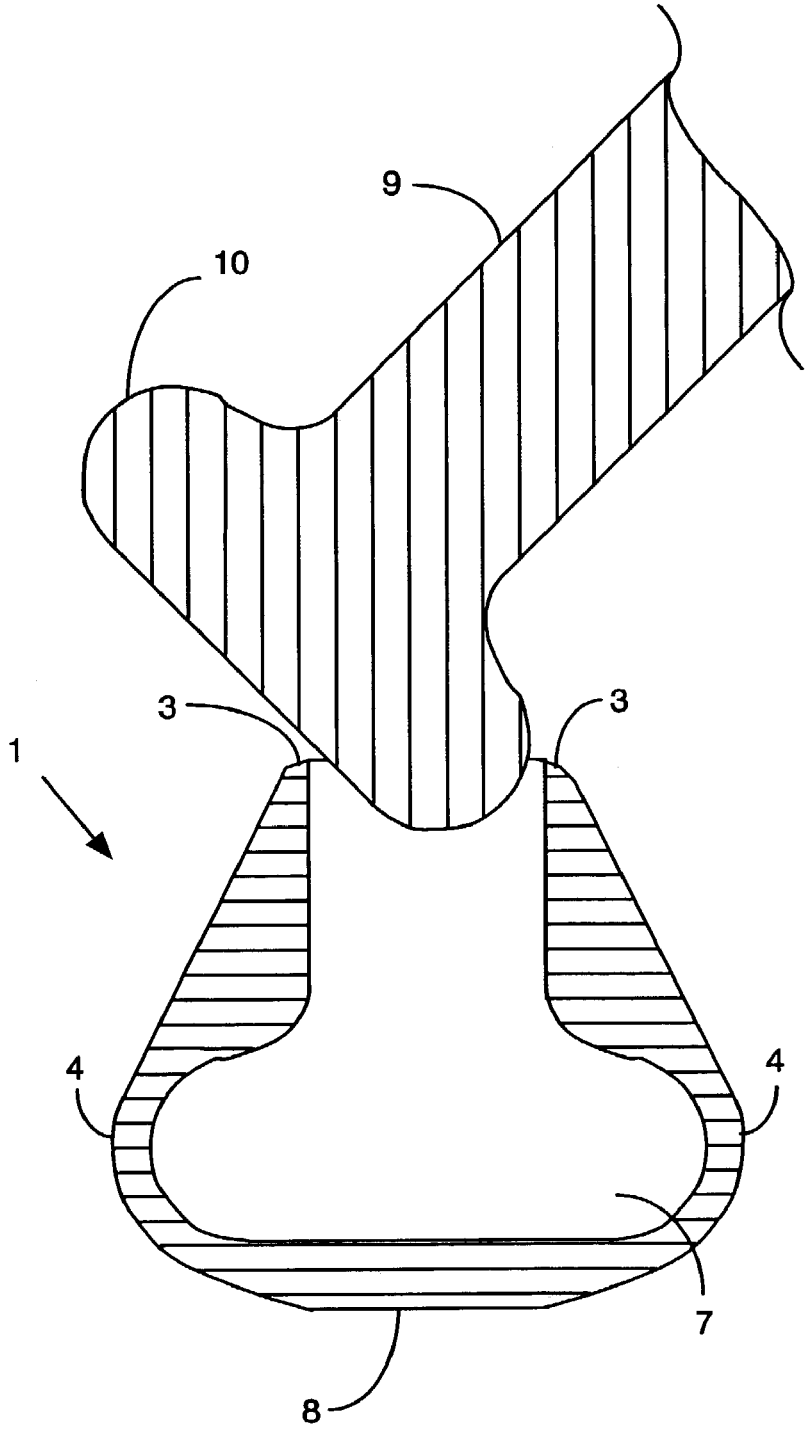
FIG. 2 illustrates the knob of a bat being inserted into a preferred embodiment of the elastic grip handle.

FIG. 2 illustrates a side cutaway view of a bat 9 being inserted into a preferred embodiment of the elastic grip handle 1. As can be seen from this illustration, the material used to fabricate the elastic grip handle 1 must be able to stretch sufficiently to allow the knob 10 of baseball/softball bat to be inserted into the channel.

Figure 3:
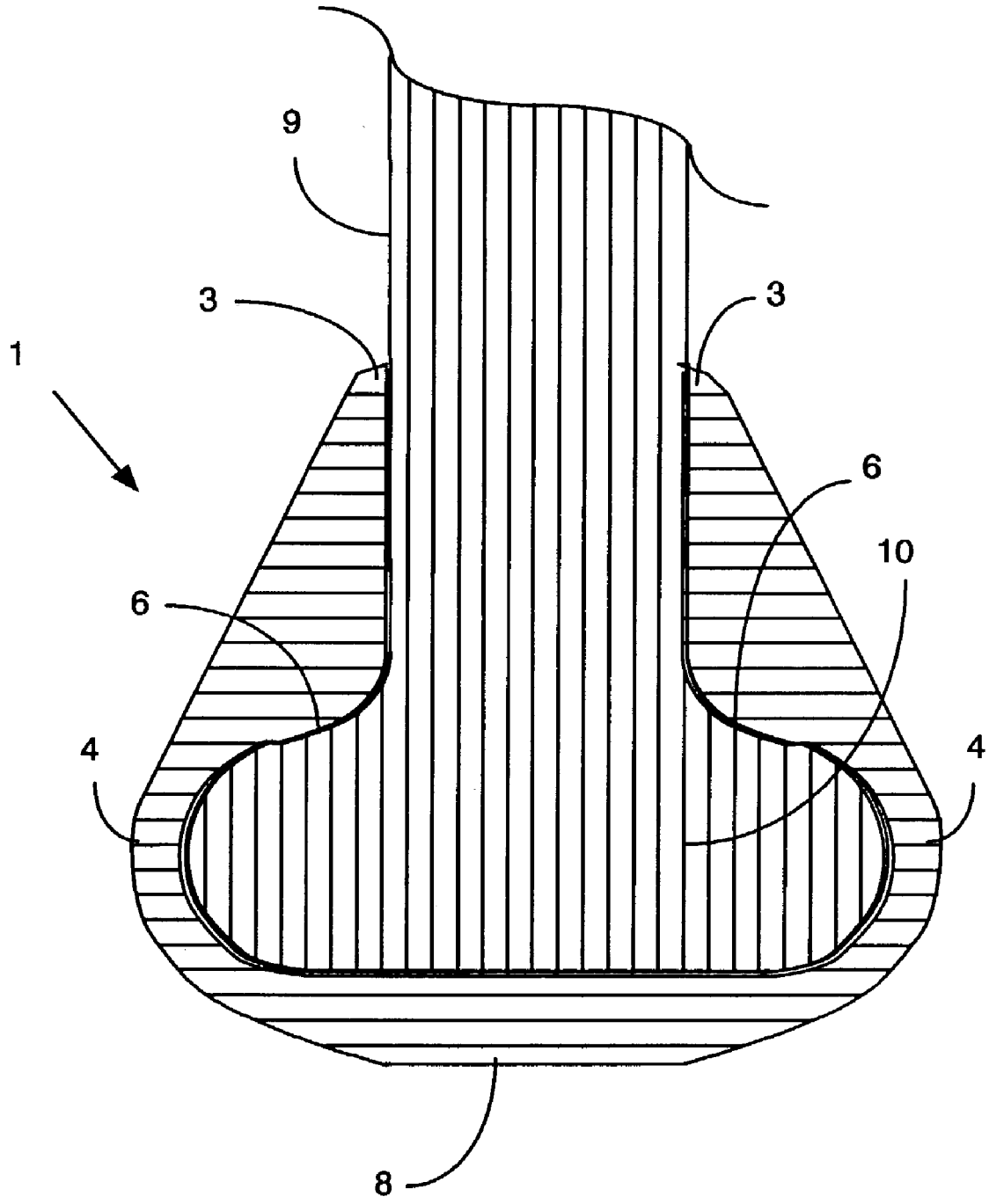
FIG. 3 illustrates the knob of a bat after insertion into a preferred embodiment of the elastic grip handle.

FIG. 3 illustrates a side cutaway view of a bat 9 which has been inserted into the elastic grip handle 1. In this preferred embodiment, the bat knob 10 as well as the bat 9 are snugly fit within the channel and knob cavity of the elastic grip handle 1. The protrusions 6 rest against the distal surface of the bat knob 10 to secure it firmly in place. In the preferred embodiment, the elastic grip handle 1 can be removably attached to the bat knob 10. However, those skilled in the art will recognize that the elastic grip handle 1 can be permanently attached to the bat knob 10 via adhesive, etc.

Figure 4:
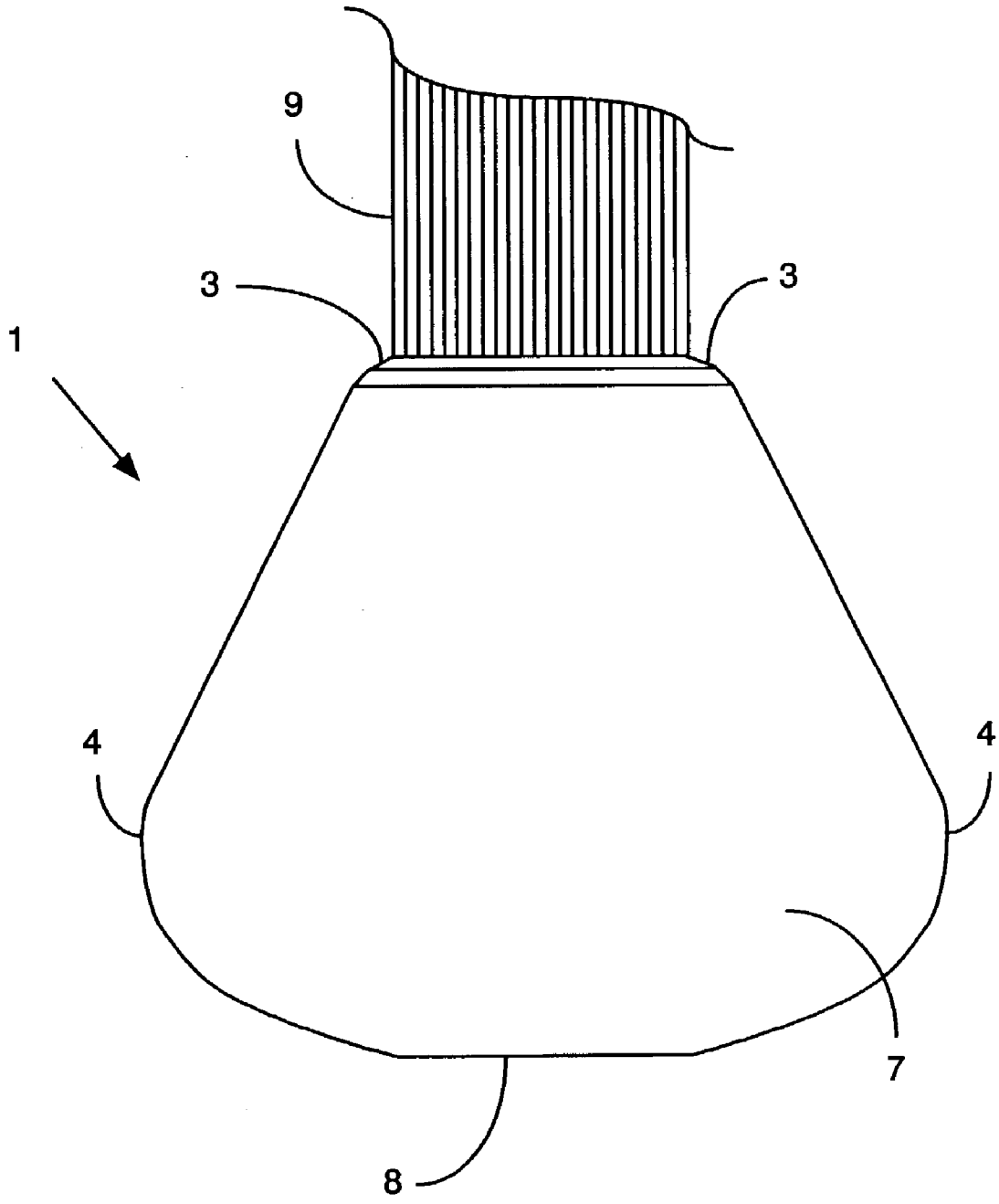
FIG. 4 is a side view of the elastic grip handle after attachment to a bat.

FIG. 4 illustrates an external side view of the elastic grip handle 1 installed onto the proximal end of a baseball/softball bat 9. This view illustrates the ridge 3 which provides a surface for resting one of the batter's fingers. By placing a finger on the ridge 3, the batter is able to provide greater resistance to prevent the bat 9 from slipping out of the batter's hand. Also shown are rounded sides 4 to which are designed to provide comfortably fit the palm of the batter's hand when it is secured by the batter's thumb.

In the preferred embodiment, the surface of the elastic grip handle 1 has a nonslip surface texture. This provides greater control of the bat 9, and prevents slippage.

Figure 5:
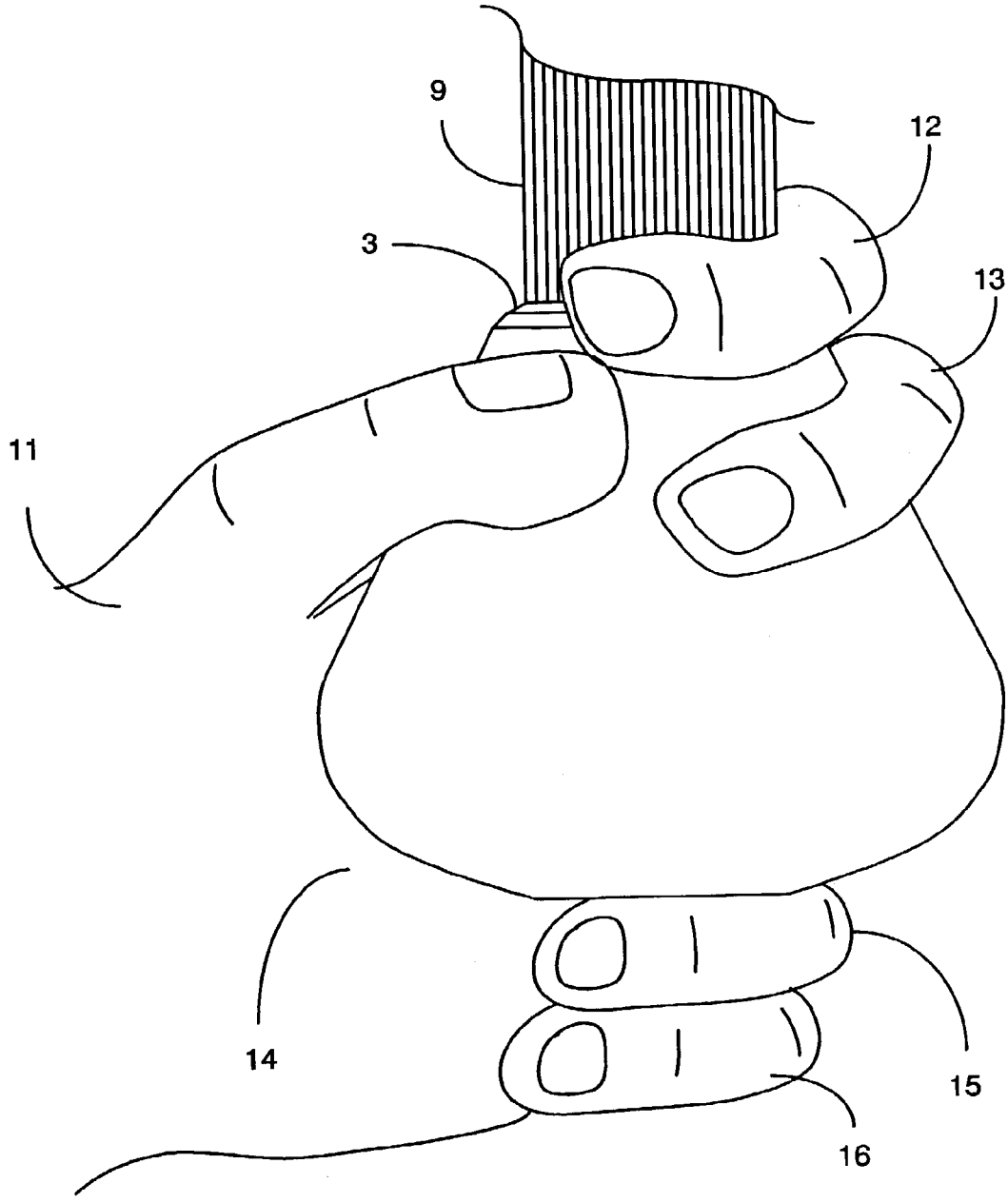
FIG. 5 illustrates a preferred embodiment of the elastic grip handle being held by the batter with three fingers.

In FIG. 5, a side view of a preferred embodiment of the elastic grip handle 1 is shown being held by a batter. In this view, the forefinger 12 of the batter rests on the ridge 3 to prevent slippage. The thumb 11 secures the elastic grip handle 1 in position with the rounded side 4 resting against the crease 14 between the batter's thumb and the palm of the batter's hand. In this illustration, the index finger 13 is shown wrapped around the elastic grip handle 1. However, the index FIG. 13 can also be moved to the proximal end of the elastic grip handle 1 where the other fingers 15, 16 are shown. The fingers 15, 16 provide extra stability and support when the bat 9 is swung.

As can be seen from this illustration, the elastic grip handle 1 allows a batter to hold the bat 9 such that the batter effectively is holding the bat at a location which is approximately equal to the location of the knob 10. This effectively allows the batter to use the entire length of the bat which results in increased leverage. Also, by gripping elastic grip handle 1 in the palm of the batter's hand, the knob 10 of the bat 9 no longer interferes with wrist movement. This helps avoid injuries, and also, it improves freedom of motion of the batter's wrist which results in greater bat speed and greater power when the bat 9 strikes the ball.

Figure 6:
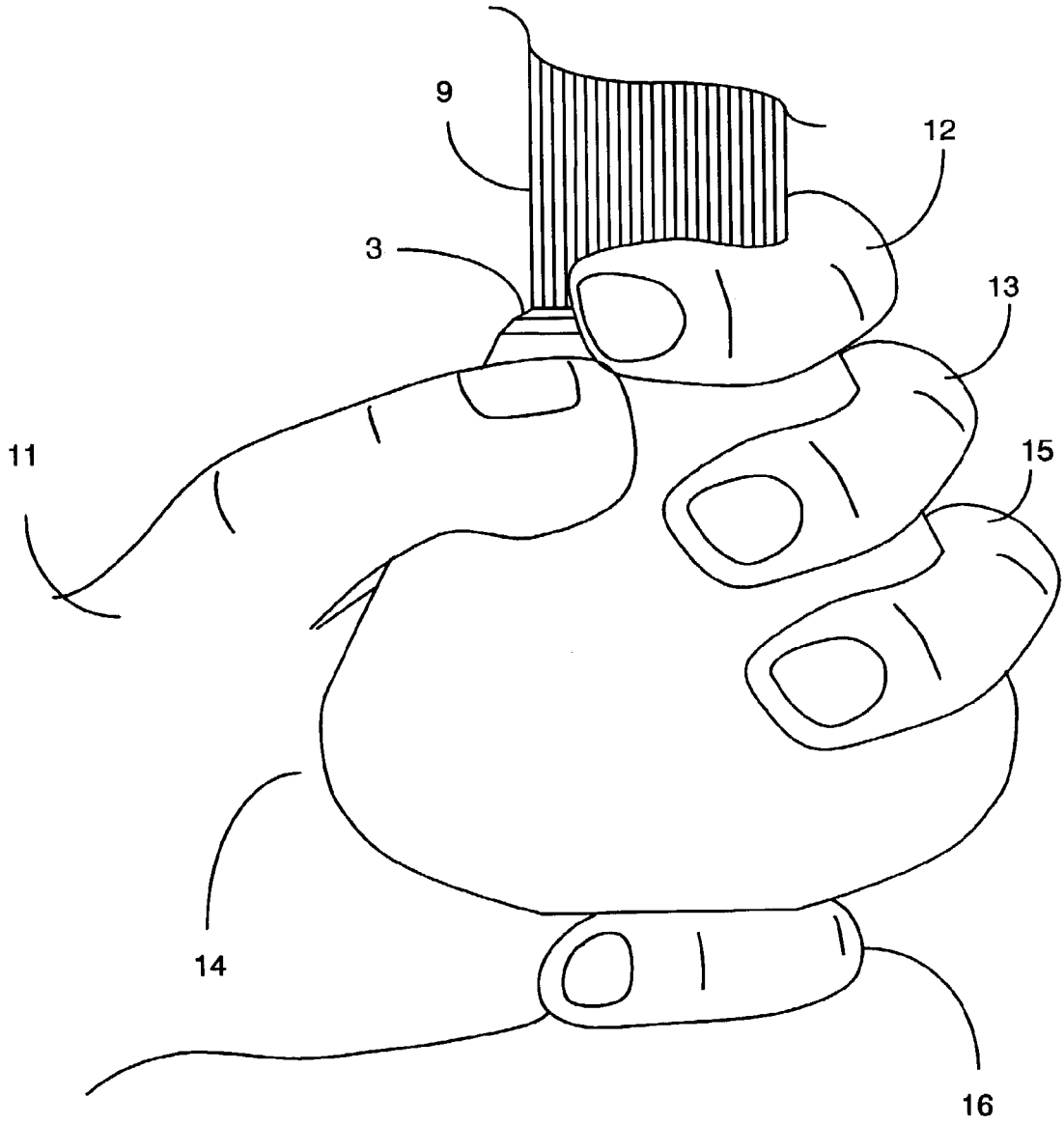
FIG. 6 illustrates a preferred embodiment of the elastic grip handle being held by the batter with four fingers.

FIG. 6 illustrates another method of holding the elastic grip handle 1. In this figure, the elastic grip handle 1 is held with the batter's thumb and three fingers 12,13,15.

Figure 7:
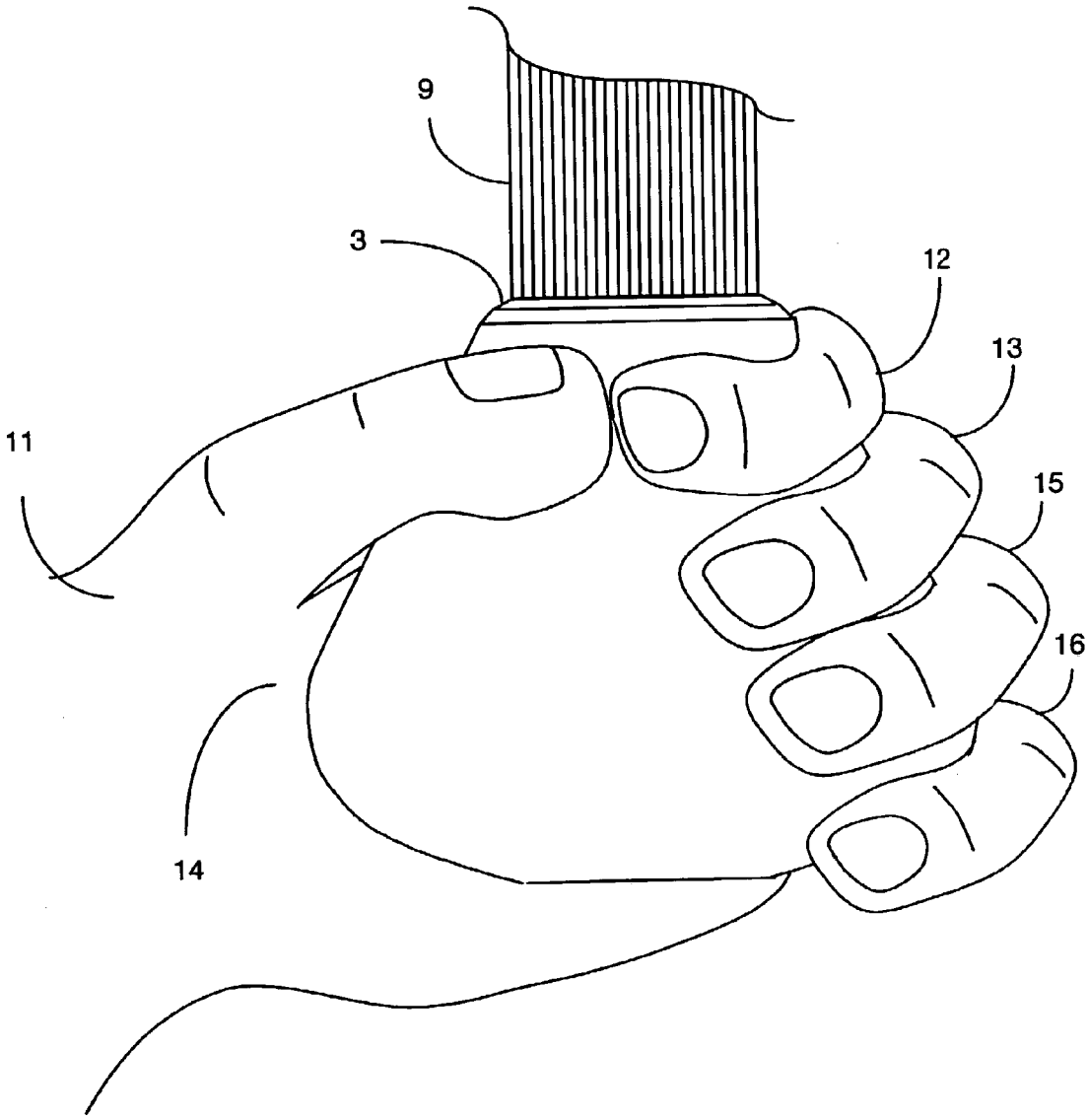
FIG. 7 illustrates a preferred embodiment of the elastic grip handle being held by the batter with five fingers.

FIG. 7 illustrates another method of holding the elastic grip handle 1. In this figure, the elastic grip handle 1 is held with the batter's thumb and four fingers 12,13,15, 16.

Figure 8:
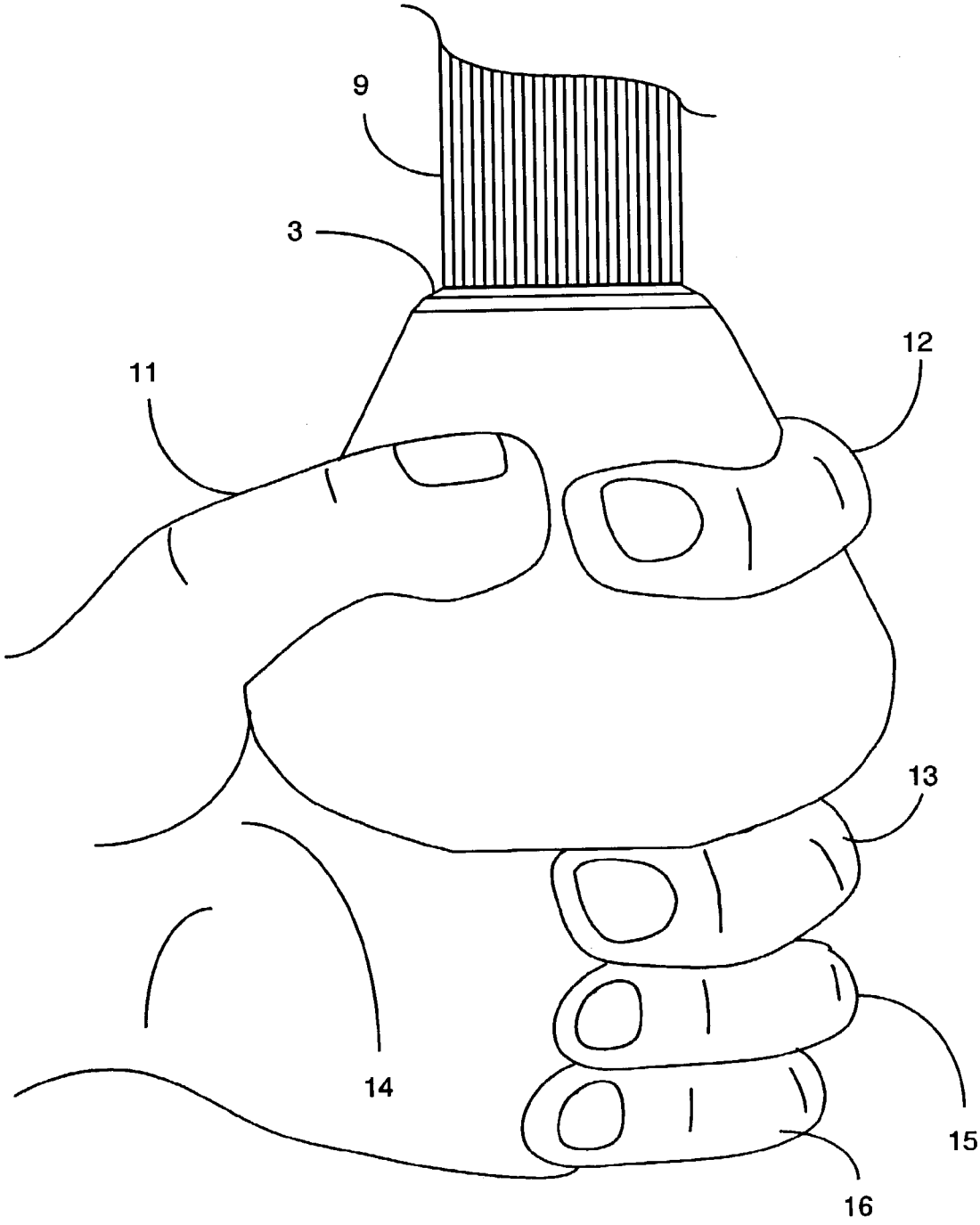
FIG. 8 illustrates a preferred embodiment of the elastic grip handle being held by the batter with a thumb and one finger.

FIG. 8 illustrates another method of holding the elastic grip handle 1. In this figure, the elastic grip handle 1 is held with the batter's thumb and one finger 12.

While the invention has been described with respect to a preferred embodiment thereof, it will be understood by those skilled in the art that various changes in detail may be made therein without departing from the spirit, scope, and teaching of the invention. For example, the elastic grip handle can be fabricated from any suitable material, the size and shape of the cavity can vary to suit differences in bat sizes, and the size of the elastic grip handle can also vary to suit variances in the size of the batter's hands. Accordingly, the invention herein disclosed is to be limited only as specified in the following claims.

We claim:

1. An elastic grip handle for a ball bat, comprising:

a knob cavity, inside the elastic grip handle, sized to snugly enclose a knob on a ball bat handle, the knob cavity having an interior shape contoured to match the exterior shape of a pre-existing bat handle/knob having a knob of larger diameter than the handle and sized such that when the knob of the ball bat is inserted, the knob cavity substantially encloses the knob, the knob fits snugly and securely within the knob cavity, and the knob is prevented form sliding out of the grip;

a handle aperture, or open end, in the elastic grip handle, the handle aperture extending from a distal end of the elastic grip handle to the knob cavity, the handle aperture providing a path for insertion of the knob of a ball bat handle into the elastic grip handle, the elastic grip handle having sufficient elasticity to allow the knob to be inserted through the handle aperture; and the outer surface of the elastic grip handle further having a substantially arcuate/conical shape with a diameter that diminishes as the elastic grip handle approaches its distal end such that when the elastic grip handle is mounted on the knob of a ball bat, the outer surface diameter of the elastic grip handle gradually diminishes as it extends up the shaft of the ball bat such that the arcuate/conical shape of the elastic grip forms a bulbous knob which fits against palm of a batter's hand, and further, the grip is sized such that it forms a widened gripping area against the palm of a batter's hand such that less than all of the batter's fingers are required to control the bat, and the batter's wrist below the knob of a baseball when the baseball bat is swung;

whereby the elastic grip handle allows the ball bat to be held by the knob on the ball bat handle such that substantially all of the length of the ball bat can be used when swinging at a ball.

2. An elastic grip handle, as in claim 1, further comprising:

and upper ridge extending inward to the ball bat handle from the outer surface, the upper ridge providing a gripping surface for least one finger of a batter;

whereby the ridge provides a gripping surface which a batter uses to prevent the bat from slipping from the batter's hand when swinging.

3. An elastic grip handle, as in claim 1, wherein:

the outer surface is further shaped to fit in the crease between the palm of the batter's hand and the batter's thumb when the batter is grasping the elastic grip handle;

whereby control is maximized by maximizing the area of the batter's hand in contact with elastic grip handle.

4. An elastic grip handle, as in claim 3, wherein:

the outer surface has a rough textured or nonslip surface to prevent slippage when the ball bat is being swung;

whereby the increased friction provided by the rough textured surface allows improved control, improved wrist mobility, improved bat speed, and improved power.

5. An elastic grip handle, as in claim 4, further comprising:

an upper ridge extending inward to the ball bat handle from the outer surface, the upper ridge providing a gripping surface for least one finger of a batter;

whereby the ridge provides a gripping surface which a batter uses to prevent the bat from slipping from the batter's hand while swinging.

6. An elastic grip handle, as in claim 5, wherein:

the elastic grip handle is removably attached to the knob of the ball bat.

7. An elastic grip handle, as in claim 5, wherein:

the elastic grip handle is permanently attached to the knob of the ball bat.

8. An elastic grip handle, as in claim 4, wherein:

the elastic grip handle is fabricated from resilient elastic materials.

9. An elastic grip handle, as in claim 8, wherein:

at least a portion of the elastic grip handle is fabricated from a filler;

whereby the filler increases surface friction on the elastic handle.

10. An elastic grip, as in claim 9, wherein:

the filler comprises up to 25 percent of the materials used to fabricate the elastic grip.

11. An elastic grip handle, as in claim 4, wherein:

the elastic grip handle is sufficiently sized and sufficiently pliant to insulate the batter's hand from impact vibrations from the ball bat caused by striking a ball;

whereby the elastic grip handle reduces the possibility of injury to the batter.

12. An elastic grip handle, as in claim 1, wherein:

the outer surface has a rough textured surface sufficient friction to prevent slippage when the ball bat is being swung;

whereby the increased friction provided by the rough textured surface allows improved hand relaxation and control, improved wrist mobility, improved bat speed, and improved power.

13. An elastic grip handle, as in claim 1, wherein:

the elastic grip handle is fabricated from resilient elastic materials.

14. An elastic grip handle, as in claim 13, wherein:

at least a portion of the elastic grip handle is fabricated from a filler;

whereby the filler increases surface friction on the elastic handle.

15. An elastic grip, as in claim 14, wherein:

the filler comprises up to 25 percent of the materials used to fabricate the elastic grip.

16. A method of swinging a ball bat, including the steps of:

covering a conventional ball bat knob with a pliant grip handle having a substantially arcuate/conical outer surface, and a knob cavity with an interior shape contoured to match the exterior shape of a pre-existing bat handle/knob that substantially encloses the knob of a ball bat and provides an expanded, bulbous area which forms a rounded bulge between the knob of the ball bat and the shaft of the ball bat that provides a continuous contact surface for the palm of a batter's hand such that the bat is secured between the palm of a batter's hand and at least one of the batter's fingers; and grasping the grip handle by the palm of the batter's hand such that the batter's wrist is below the knob of the ball bat when the ball bat is swung, and the bat does not interfere with the movement of the batter's wrist;

whereby holding the bat such that the knob of the bat does not interfere with the batter's wrist movement provides increased wrist mobility, increased bat speed, increased power, and the reduced possibility of injury to the batter.

17. A method, as in claim 16, including the additional step of:

roughening the outer surface of the pliant grip handle to increase friction between the batter's hand and the pliant grip handle;

whereby the increased friction reduces slippage and improved control of the ball bat.

18. A method, as in claim 17, including the additional step of:

preventing slippage of the ball bat from the batter's hand by providing a ridge on the pliant grip handle suitable for finger to rest on, and to prevent the pliant grip handle from slipping through a batter's fingers;

whereby control of the bat is increased by providing a ridge for the finger of a batter to secure the grip.

19. A method, as in claim 18, including the additional step of:

sizing the pliant grip such that at least one finger can be dropped off of the pliant grip handle, and sizing the pliant grip such that the bat can be controlled by the batter using a thumb and one finger to secure the pliant grip in the palm of the batter's hand;

whereby bat velocity is increased by eliminating interference caused by the batter's fingers when swinging the ball bat.

20. A method, as in claim 17, including the additional step of:

fabricating the pliant grip from resilient elastic materials in combination with a filler.

* * * * *